US012798743B2

(12) United States Patent
Köhlberg et al.

(10) Patent No.: US 12,798,743 B2
(45) Date of Patent: Nov. 17, 2026

(54) TRANSOM BRACKET WITH ADJUSTABLE HEIGHT

(71) Applicant: VOLVO PENTA CORPORATION, Gothenburg (SE)

(72) Inventors: Dennis Köhlberg, Gothenburg (SE); Jonas Brask, Olsfors (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 293 days.

(21) Appl. No.: 18/645,901

(22) Filed: Apr. 25, 2024

(65) Prior Publication Data

US 2024/0367771 A1 Nov. 7, 2024

(30) Foreign Application Priority Data

May 2, 2023 (EP) ..... 23171046

(51) Int. Cl.
*B63H 20/02* (2006.01)
*B63H 20/06* (2006.01)
(Continued)

(52) U.S. Cl.
CPC ..... *B63H 20/02* (2013.01); *B63H 20/06* (2013.01); *B63H 20/28* (2013.01); *B63H 21/17* (2013.01)

(58) Field of Classification Search
CPC ..... B63H 20/00; B63H 20/02; B63H 20/06; B63H 20/28; B63H 21/00; B63H 21/17; B63H 21/30; B63H 5/00
(Continued)

(56) References Cited

U.S. PATENT DOCUMENTS 3,669,057 A * 6/1972 Shimanckas ..... B63H 20/02 440/112
6,267,632 B1 7/2001 Blanchard
(Continued)

FOREIGN PATENT DOCUMENTS

EP 3939880 A1 1/2022
WO 2021121623 A1 6/2021

OTHER PUBLICATIONS

Extended European Search Report in corresponding European Application No. 23171046.8 dated Nov. 10, 2023 (5 pages).
(Continued)

*Primary Examiner* — Lars A Olson
(74) *Attorney, Agent, or Firm* — Jeffri A. Kaminski; Venable LLP

(57) ABSTRACT

A transom bracket for supporting a marine drive unit on a hull of a marine vessel extends in a plane spanned by a first axis and by a second axis, where a third axis is normal to the plane. The transom bracket includes one or more apertures facing transversal to the plane, the one or more apertures being arranged to route media past the plane to and from the marine drive unit, via a routing area in the plane, where the routing area extends over a routing area distance measured along the first axis. The transom bracket includes at least one fastening option array extending over a translation distance measured along the first axis, where the fastening option array is configured to allow offset of the transom bracket relative to the hull along the first axis by the translation distance The transom bracket includes a sealing arrangement to seal against the hull in direction of the third axis, where the sealing arrangement extends along the periphery of a sealing region in the plane, where the sealing region is a region in the plane at least as large as to maintain seal against
(Continued)

the hull during translation of the transom bracket along the first axis by the translation distance.

19 Claims, 5 Drawing Sheets

(51) Int. Cl.
*B63H 20/28* (2006.01)
*B63H 21/17* (2006.01)

(58) Field of Classification Search
USPC ..... 440/111, 112
See application file for complete search history.

(56) References Cited

U.S. PATENT DOCUMENTS

| | | | | |
|---|---|---|---|---|
| 7,175,491 | B1 * | 2/2007 | Davis | B63H 20/02 440/111 |
| 9,481,435 | B1 | 11/2016 | Jaszewski et al. | |
| 10,618,617 | B2 | 4/2020 | Suzuki et al. | |
| 11,377,186 | B1 | 7/2022 | Ahlswede et al. | |
| 2022/0242544 | A1 | 8/2022 | Schatz | |

OTHER PUBLICATIONS

European Communication under Rule 71(3) EPC dated Jul. 8, 2025 in corresponding European Patent Application No. 23171046.8, 34 pages.

* cited by examiner

TRANSOM BRACKET WITH ADJUSTABLE HEIGHT

TECHNICAL FIELD

This disclosure relates generally to marine drive units. In particular aspects, the disclosure relates to transom brackets for marine drive units. Aspects of the disclosure can be advantageously applied in leisure craft and in smaller commercial vessels. Although the disclosure may be described with respect to a particular marine vessel type, the disclosure is not restricted to any particular type of boat or ship.

BACKGROUND

Marine vessels such as leisure craft and smaller commercial vessels can be powered by one or more propeller arrangements supported by respective drive units. The drive units may, e.g., be mounted at the transom of the vessel, or at the bottom of the hull. The hull shape and drive unit configuration can vary from one vessel to another, and sometimes more than one drive unit is mounted, e.g., in twin configuration or quad configuration. There is a desire to provide a transom bracket which is versatile and that can be adapted for use with more than one type of vessel and/or with more than one type of drive unit configuration in a convenient manner.

SUMMARY

It is an objective of the present disclosure to provide improved transom brackets, drive unit assemblies and marine vessels. The objective is at least in part obtained by a transom bracket for supporting a marine drive unit on a hull of a marine vessel. The transom bracket extends in a plane spanned by a first axis and by a second axis, where a third axis is normal to the plane. The transom bracket comprises one or more apertures facing transversal to the plane, the one or more apertures being arranged to route media past the plane to and from the marine drive unit, via a routing area in the plane. The routing area extends over a routing area distance measured along the first axis, and it is the area in the plane that is required in order to route media to and from the drive unit. The transom bracket also comprises at least one fastening option array extending over a translation distance measured along the first axis. The fastening option array is configured to allow offset of the transom bracket relative to the hull along the first axis by the translation distance, which allows, e.g., a boat builder to optimize the vertical placement of the drive unit in a convenient manner. The transom bracket furthermore comprises a sealing arrangement configured to seal against the hull in direction of the third axis. The sealing arrangement extends along the periphery of a sealing region in the plane. This sealing region is a region in the plane that is at least as large as to maintain seal against the hull during translation of the transom bracket along the first axis by the translation distance. This means that the transom bracket can be offset on the transom, e.g., to optimize the installation, without changing the geometry of the sealing arrangement nor of the cutout in the transom. The sealing arrangement is configured to seal against the hull in all possible installation options (vertical offsets) of the transom bracket, which is an advantage made possible since the sealing region has been expended at least vertically in comparison to a nominal sealing region required to cover all the routing media apertures in the transom bracket. There is no need to change the cutout in the transom as the transom bracket is offset vertically on the transom, as long as the offset distance does not exceed the translation distance along the first axis.

The one or more apertures define an aperture area that extends over an aperture distance measured along the first axis. The transom bracket is arranged offsetable over the routing area along the first axis by the difference between the aperture distance and the routing area distance. According to a first example of the above sealing region feature, this aperture distance is larger than or equal to a sum of the routing area distance and the translation distance. In this case the sealing region extends over a sealing distance measured along the first axis that is at least as large as the sum of the routing area distance and the translation distance, which ensures that the sealing region is at least as large as to maintain seal against the hull during translation of the transom bracket along the first axis by the translation distance.

According to a second example of the above, the one or more apertures define an aperture area that extends over an aperture distance measured along the first axis that is smaller than a sum of the routing area distance and the translation distance. In this case it is necessary to enlarge the cutout in the transom beyond that required to pass the routing media. The scaling region in this case extends over a sealing distance measured along the first axis that is at least as large as the difference between twice the sum of the routing area distance and the translation distance and the aperture distance, i.e., $d_S > 2d_R + 2d_T - d_A$, where $d_S$ is the scaling distance, $d_R$ is the routing area distance, $d_T$ translation distance, and $d_A$ is the aperture distance. This again ensures that the sealing region is at least as large as to maintain seal against the hull during translation of the transom bracket along the first axis by the translation distance.

A distance from the sealing arrangement to the closest aperture upwards and/or downwards on the transom bracket in use, measured along the first axis, is preferably at least as large as the translation distance. In other words, the design of the transom bracket, and in particular the sealing arrangement on the transom bracket, has been enlarged to extend further vertically than just around the apertures, in order to allow vertical offset by the transom bracket on the transom without changing the cutout in the transom or making any other adjustments.

The fastening option array may, e.g., be an array of bolt holes or an array of bolts, or an array of some other type of fastening members. The array of fastening options allow the transom bracket to be moved around on the transom by selecting, e.g., corresponding bolt holes in bolt hole arrays for mounting the transom bracket to the transom, or pin bolts arranged in arrays on the transom bracket. Regardless of the selected vertical position on the transom, the apertures open up in the transom cutout and are not blocked by the transom. Also, regardless of the selected vertical position on the transom the sealing member will seal the entire cutout portion in the transom. Consequently, the transom bracket can be moved around vertically on the transom in a straightforward manner, and the overall operation of the drive unit assembly can be conveniently optimized. At least two bolt holes, and preferably five bolt holes are preferred. The bolt holes in the at least one fastening option array can be separated by between 10-20 mm, and preferably by about 16 mm for some transom bracket. The transom bracket preferably comprises at least four fastening option arrays, and preferably six fastening option arrays in order to hold the drive unit securely in position on the transom. According to an example, at least one of the fastening option arrays is enclosed by the sealing region, and at least one of the fastening option arrays is located external to the sealing region. It is, however, appreciated that a wide variety of different fastening options are possible within the scope of the present disclosure.

According to an example, the at least one fastening option array extends along a straight line parallel to the first axis. However, it is also possible that the fastening option array extends in direction of the second axis. In this case the size of the sealing region must be expanded also in the second axis dimension, as will be explained in the following.

The sealing arrangement preferably comprises a groove arranged to receive a replaceable scaling member. This is an advantage since the seal can be replaced in a convenient manner as the transom bracket is offset on the transom. When the transom bracket is to be offset vertically on the transom, it is first released, whereupon the seal can be replaced before the transom bracket is again attached at some other position on the transom.

The objective is also at least in part obtained by a transom bracket for mounting a marine drive unit to the hull of a marine vessel. The transom bracket extends in a plane spanned by a first axis and by a second axis, where a third axis is normal to the plane, and where a center line of the transom bracket extends in the plane and parallel to the first axis. The transom bracket comprises at least one drive unit support for holding the drive unit in position on the transom. The drive unit is preferably supported on the transom in a pivotable manner such that the drive unit can be pivoted relative to the transom bracket into an up-tilted storage position. The transom bracket also comprises a first water conduit and a second water conduit integrated in the transom bracket, where the first water conduit and the second water conduit extend from respective upper apertures formed in an upper part of the bracket to respective lower apertures formed in a lower part of the bracket, where the lower apertures are separated from each other by the center line. It is also an advantage that the water conduits are integrated in the transom bracket together with the drive unit supports, since no additional water conduits are needed. Hence, the transom bracket has at least dual functions: that of supporting the drive unit and that of providing cooling water to one or more onboard systems in need of cooling. The arrangement where the water conduit lower apertures are separated by the center line and located on both sides of the transom bracket also brings the additional advantage that at least one of the lower apertures will be located close to the water, even if the transom bracket is displaced laterally on the transom from the vessel center. This is a particular advantage on, e.g., twin drive unit installations where drive units are laterally offset on the transom and where the distances to the water level from the water conduit lower apertures differ from one side of the transom to the other side on the transom in use. The center line can be a symmetry line of the lower apertures about the first axis, although this is not necessary. The first water conduit and the second water conduit can extend symmetrically about the center line, such as in parallel along straight lines, or in some other way, symmetric or asymmetric, from the upper apertures down to the lower apertures.

The first water conduit and/or the second water conduit preferably comprises an adjustable length portion arranged in connection to the respective lower aperture. This adjustable length portion can for instance be a telescopic member or a portion that extend out from the bracket and that can be cut to a desired length measured along the first axis. The adjustable length portion can also be a conveniently replaceable section that can be selected according to preferred length. It can also be some other adjustable length mechanism, that can be used by an installer of the transom bracket to fine-tune the position of water intake relative to the hull, such as a threaded tubular member. The adjustable length portion allows a boat builder to adjust the length of the water conduit in a convenient manner to match a distance from the transom bracket lower end to the water level.

At least one drive unit support of the transom bracket may be configured to enclose an aperture facing transversal to the plane. In other words, the aperture and the drive unit support are integrally formed, such that the drive unit support opens up towards the transom in the plane. This allows for connections and interfaces, such as electrical cables and hydraulic connections, to pass to and from the drive unit via the drive unit support, which is an advantage since they are protected by the transom bracket. An electrical cable harness may, e.g., pass from an electrical energy storage inside the hull out via a pivot point of the drive unit to an electric machine of the drive unit. The passage through the pivot point means that the electrical cable is not subject to very much bending as the drive unit is trimmed and pivoted.

There is also disclosed herein a marine drive unit assembly comprising a transom bracket, a drive unit supported by the transom bracket, and a water pump. The drive unit is arranged to be tilted from a nominal position where at least part of the drive unit is submerged in water to an up-tilted position where at least a propeller arrangement of the drive unit is above water. The first water conduit, the second water conduit, and the water pump forms part of a cooling circuit operable to transfer water via at least one of the first and second water conduits when the drive unit is in the nominal position and also when the drive unit is in the up-tilted position, which is an advantage since it allows cooling of, e.g., an electrical energy storage system also in the up-tilted position. The cooling circuit is operable to cool any component inside or outside the hull, regardless of whether the drive unit is in the up-tilted position or not, which is an advantage. The cooling circuit may for instance comprise a first sub-circuit extending via an electrical energy storage comprised in the marine drive unit assembly and/or a second sub-circuit that passes via an electric machine comprised in the drive unit. The cooling circuit optionally also comprises a valve arrangement configurable to exclude the electric machine from the cooling circuit when the drive unit is in the up-tilted position. This reduces the strain on the cooling circuit in the up-tilted position where the drive unit is normally not in need of cooling.

The different technical details related to the water conduits integrated in the transom bracket, the drive unit supports, and the sealing arrangement may advantageously be combined, but can also be used separately from each other. There are no strict dependencies between the different technical features and advantages of the different transom bracket parts discussed herein.

The disclosed aspects, examples (including any preferred examples), and/or accompanying claims may be suitably combined with each other as would be apparent to anyone of ordinary skill in the art. Additional features and advantages are disclosed in the following description, claims, and drawings, and in part will be readily apparent therefrom to those skilled in the art or recognized by practicing the disclosure as described herein.

BRIEF DESCRIPTION OF THE DRAWINGS

Examples are described in more detail below with reference to the appended drawings.

DETAILED DESCRIPTION

The detailed description set forth below provides information and examples of the disclosed technology with sufficient detail to enable those skilled in the art to practice the disclosure.

Figure 1:
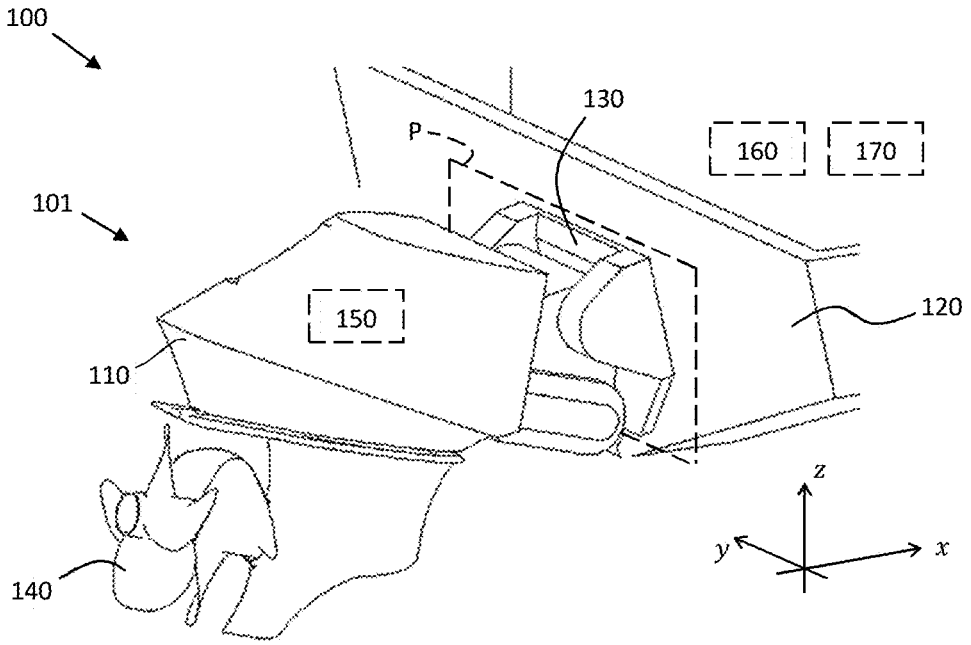
FIG. 1 illustrates an example transom-mounted marine drive unit.

FIG. 1 shows a marine vessel 100 with a drive unit 110 mounted to the transom of a hull 120. A transom bracket 130, sometimes referred to as a transom shield, holds the drive unit 110 in position on the hull 120. The drive unit 110 comprises a propeller arrangement 140 which provides thrust that propels and often also steers the vessel 100. The thrust generated by the propeller arrangement 140 is transferred to the hull 120 via the transom bracket 130. Hence, it is important that the transom bracket has sufficient mechanical strength in order to withstand the forces involved. A marine vessel may generally comprise one or more drive units, that comprise one or more propeller arrangements. The drive unit 110 comprises a main power source, such as an electric machine 150, which powers the propeller arrangement 140.

A set of reference axes x, y, z will be used herein to describe various geometrical relationships. The x-axis is a longitudinal axis extending in the forward direction of the hull. The y-axis is a lateral axis perpendicular to the x-axis. The z-axis is a vertical axis normal to a plane spanned by the x and y axes.

The drive unit 110 forms part of a drive unit assembly 101 which normally also comprises a cooling system to control temperatures of the various components of the drive unit assembly 101. The cooling system comprises a water pump 160 configured to pump water through a cooling circuit. The cooling circuit normally comprises one or more cooling media sub-circuits that exchange heat with the sea or lake water pumped by the water pump 160. The sub-circuits can be configured to cool the main power source 150 and optionally also an electric energy storage 170 of the vessel 100. Both the water pump 160 and the electric energy storage 170 of the vessel 100 are schematically illustrated in FIG. 1. The electrical energy storage 170 and the drive unit 110 are normally located on separate sides of the transom, i.e., separated by the plane P shown in FIG. 1, although some drive units also support an integrated electrical energy storage. Water pumps are well known and will therefore not be discussed in more detail herein. Electrical energy storage systems, such as battery banks, are also well known in the art and will therefore not be discussed in more detail herein.

More than one electric machine 150 is of course an option, as well as more than one water pump 160 and/or more than one electrical energy storage 170.

Figure 2:
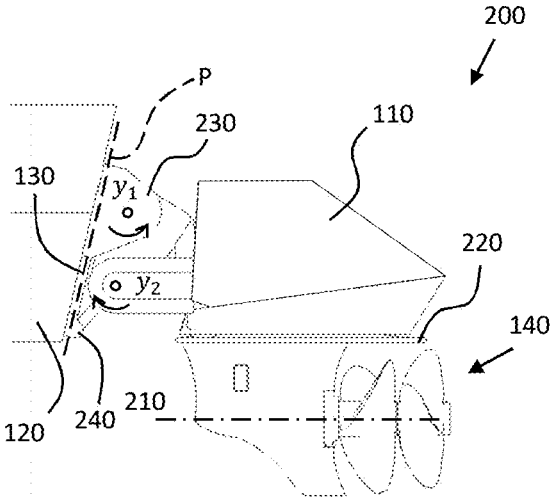
FIG. 2 shows an example marine drive unit in nominal position.

FIG. 2 illustrates an example drive unit 110 in a nominal operating position 200 where the propeller arrangement 140 is positioned under the water surface and operable to propel the vessel 100.

The drive unit 110 is pivotably supported by a first support member 230 and by a second support member 240, which are attached to respective drive unit supports on the transom bracket 130. These drive unit interfaces may, e.g., comprise bolt holes or the like. The first support member 230 and/or the second support member 240 may also be integrally formed with the transom bracket 130.

This particular drive unit 110 is pivotable about a first pivot axis $y_1$ and also about a second pivot axis $y_2$ that is spatially offset from the first pivot axis $y_1$ along the z-axis. Pivoting by the drive unit 110 about the second pivot axis $y_2$ may be used for trim of the thrust elevation angle of the propeller arrangement 140, while pivoting about the first pivot axis $y_1$ can be used for tilting the drive unit 110 into an up-tilted position. Pivoting about both the first pivot axis $y_1$ and about the second pivot axis $y_2$ may be used to reduce the draught of the drive unit 110, i.e., to position the propeller arrangement 140 close to the water surface. To operate the drive unit 110 at reduced draught, it is pivoted counter-clockwise about the first pivot axis $y_1$ in FIG. 2 and clockwise above the second pivot axis $y_2$ in FIG. 2. This moves the propeller arrangement 140 rearwards and upwards to the position of reduced draught, while maintaining the horizontal propeller axle 210 at least approximately horizontal. It is an advantage that the transom bracket supports operation at reduced draught.

Figure 3:
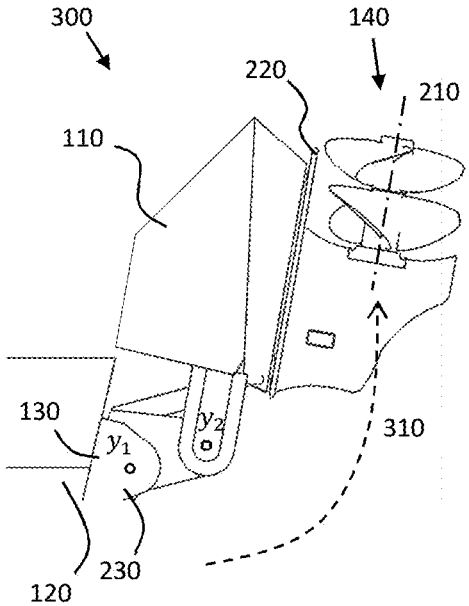
FIG. 3 shows an example marine drive unit in up-tilted position.

FIG. 3 illustrates an example drive unit 110 in up-tilted position 300, where the drive unit 110 has been moved 310 to a position above water. This position is commonly used as storage position since no biofouling occurs when the drive unit is up-tilted and above water.

Conventional marine drive units normally comprise water conduits for cooling that are integrated in the drive unit, and that open up in lower apertures in vicinity of the propeller arrangement, such as on the propeller side of the cavitation plate 220. These lower apertures are submerged in the nominal position but will be above water in the up-tilted position. This is a problem in case of an electric drive line which comprises an electrical energy storage 170 in need of cooling also when the drive unit 110 is in the up-tilted position 300. Cooling of the electrical energy storage system 170 may, e.g., be required during charging, and in case of high ambient temperatures. A functional sea-water intake may also be required by other auxiliary equipment on the vessel 100, during periods when the drive unit 110 is in the up-tilted position 300. Some of the transom brackets discussed herein solve this issue by integrating the water intake in the transom bracket, where it is operable also when the drive unit 110 is in the up-tilted position 300.

Figure 4A:
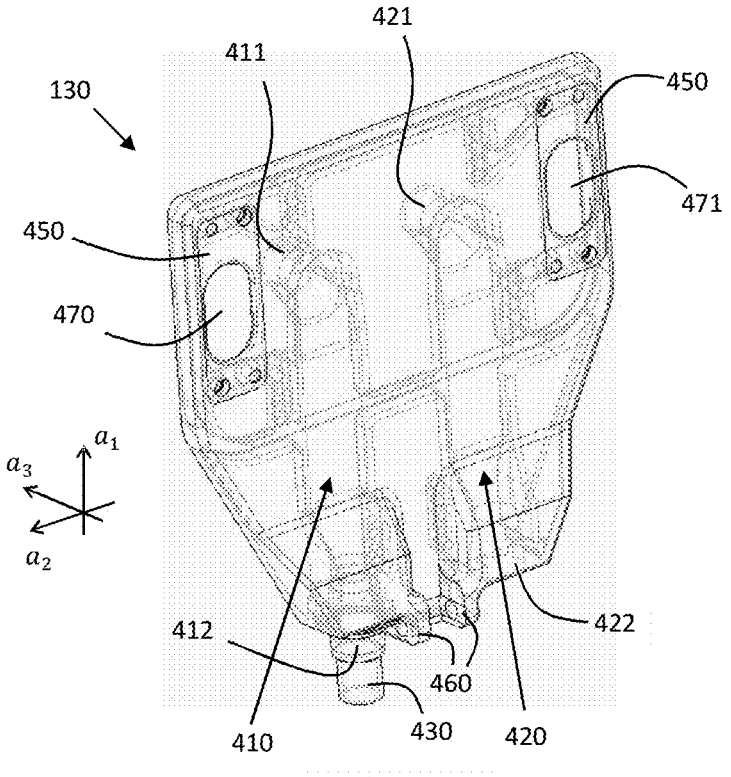
FIGS. 4A-B show an example transom bracket with dual water conduits.
Figure 4B:
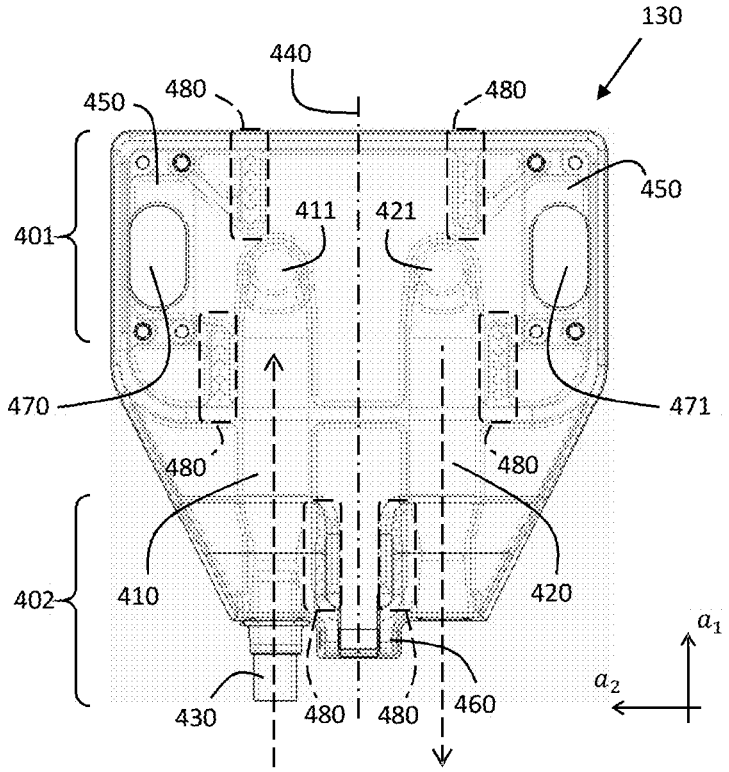

FIGS. 4A and 4B illustrate an example transom bracket 130 for mounting a marine drive unit 110 to the transom part of a hull 120 of a marine vessel 100, such as the marine vessel illustrated in FIGS. 1-3. The various aspects of the transom brackets disclosed herein will be illustrated using a single example. It is, however, appreciated that the different transom bracket features disclosed herein can be applied more generally to different types of transom brackets arranged to support different types of drive units.

The transom bracket 130 extends in a plane P, as illustrated in FIG. 1 and in FIG. 2. The plane P is spanned by a first axis $a_1$ and by a second axis $a_2$. A third axis $a_3$ is normal to the plane P, and a center line 440 of the transom bracket 130 extends in the plane P and parallel to the first axis $a_1$.

The first axis $a_1$ and the second axis $a_2$ are generally pivoted relative to the reference axes z, y in FIG. 1, but are often at least approximately vertical and horizontal, respectively, depending on the geometry of the hull transom. The first axis $a_1$ is directed upwards on the transom when the transom bracket 130 is mounted, and the second axis $a_2$ is directed laterally across the transom from the starboard side to the port side when the transom bracket 130 is mounted.

The transom bracket 130 comprises at least one drive unit support 450, 460 for holding the drive unit 110 in position. In the illustrated examples this drive unit support has an upper part 450 and a lower part 460. The lower part may be used to support a tilt actuator as illustrated in FIG. 2, while the upper part 450 may be used to pivotably support the drive unit 110. It is noted that the upper drive unit supports 450 enclose apertures 470, 471 that extend through the transom bracket 130, across the plane P. These apertures can be used to route media from inside the hull to the drive unit 110. The media can then pass via a pivot axle of the drive unit.

According to a more general teaching, one or more apertures 470, 471 of the transom bracket 130 can be arranged facing transversal to the plane P, in direction of the third axis $a_3$ or angled relative to the third axis $a_3$, and formed inside at least one of the drive unit supports 450, 460. This aperture or apertures allow a harness, such as an electrical harness or part of a hydraulic connection to pass from inside the hull to the drive unit through the transom bracket in an efficient manner. The upper apertures 411, 421 of the first and second water conduits 410, 420 in this example are arranged facing in direction of a third axis $a_3$ transversal to the plane P, i.e., towards the interior of the vessel 100 but not necessarily in parallel with the third axis $a_3$, and the lower apertures are arranged facing in direction of the first axis $a_1$, i.e., towards the water. At least one of the first and second water conduits 410, 420 optionally has a non-circular cross section. The non-circular cross section allows for a larger cross section area in cases where the thickness of the transom bracket (direction of a third axis $a_3$) is limited.

The transom bracket 130 comprises a first water conduit 410 and a second water conduit 420 integrated in the transom bracket 130. The first water conduit 410 and the second water conduit 420 extend from respective upper apertures 411, 421 formed in an upper part 401 of the bracket 130 to respective lower apertures 412, 422 formed in a lower part 402 of the bracket 130. The upper apertures 411, 421 are here angled to face in direction of the third axis $a_3$ while the lower apertures face downwards along the first axis $a_1$. This simplifies installation and improves the capability of the water conduit to take in water. However, both the upper apertures and the lower apertures can be angled differently compared to the example in FIG. 4A. Both water conduits 410, 420 here extend downwards along straight parallel lines. This is also not necessary, both water conduit can have different extension paths, not necessarily symmetric.

Herein, "upper" and "lower" refer to relative positions with respect to the first axis $a_1$. Hence, the lower part 402 of the bracket 130 is closer to the water in use compared to the upper part 401 of the bracket. The lower apertures 412, 422 are separated from each other by a center line 440 indicated in FIG. 4B. The center line 440 is a line that lies in the extension plane P of the transom bracket, and which divides the transom bracket into two parts in direction of the first axis $a_1$. These two parts may be of equal extension length along the second axis $a_2$, i.e., the center line 440 may divide the transom bracket into two halves a port side and a starboard side. The two halves need not be exactly equal in size, although the center line 440 in the illustrated examples is a symmetry line of the transom bracket 130. The center line 440 is preferably a symmetry line of at least the lower apertures 412, 422 about the first axis $a_1$. The first water conduit 410 and the second water conduit 420 may extend symmetrically about the center line 440, although this is not necessary for the sea water intake functions discussed herein.

Figure 5:
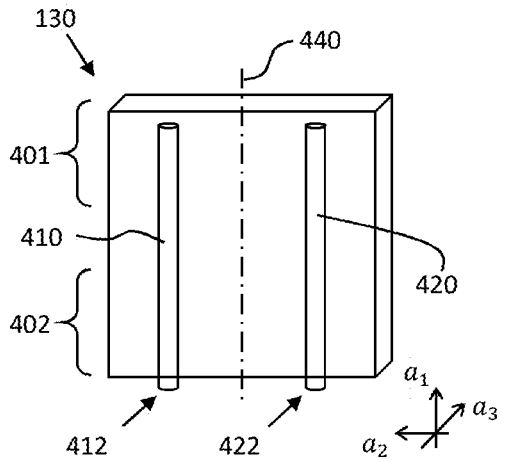
FIG. 5 schematically illustrates water conduits integrated in a transom bracket.

According to preferred aspects, the first water conduit 410 and the second water conduit 420 are intersected by the plane P, and a symmetry line 440 of the first and second water conduits 410, 420 extends in the plane P in parallel with the first axis $a_1$ at the center of the transom bracket, as illustrated in FIG. 4B and more schematically in FIG. 5. Any of the first water conduit 410 and the second water conduit 420 can be arranged as intake channel for the cooling circuit, and the other is then arranged as discharge channel. This is primarily advantageous in installations comprising more than one drive unit, such as in twin drive unit installations or quad drive unit installations. Since the water channel located closest to the water in use can be selected as the water intake in a convenient manner, without changes to the transom bracket. The same transom bracket can also be used on the starboard side and on the port side which is an advantage. Installations comprising three or more drive units also benefit from this feature of having integrated water conduits with lower apertures separated by the transom bracket center line 440. A twin drive unit installation will be discussed below in connection to FIG. 8.

Figure 6:
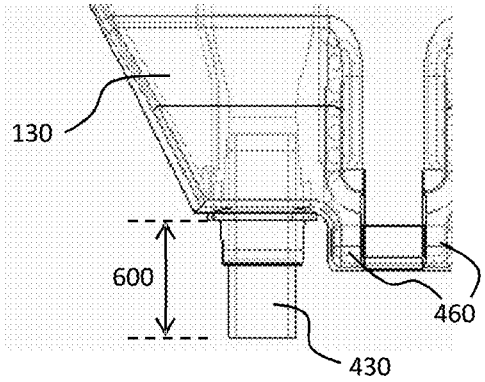
FIG. 6 illustrates details of a water conduit in an example transom bracket.

At least one out of the first water conduit 410 and the second water conduit 420 can be configured with an adjustable length portion 430 arranged in connection to the respective lower aperture 412, 422 of the water conduit as illustrated in FIG. 6. The adjustable length portion 430 may, e.g., be a telescopic member or a portion that can be cut to a desired length in a convenient manner by the boat builder. The adjustable length portion may be extendible 600 in direction of the first axis $a_1$, as illustrated in FIG. 6, or in some other downwards direction. The adjustable length portion can be used with advantage to match a water intake location to the hull shape as the transom bracket is adjusted along the first axis $a_1$ as will be discussed in more detail below.

Figure 7:
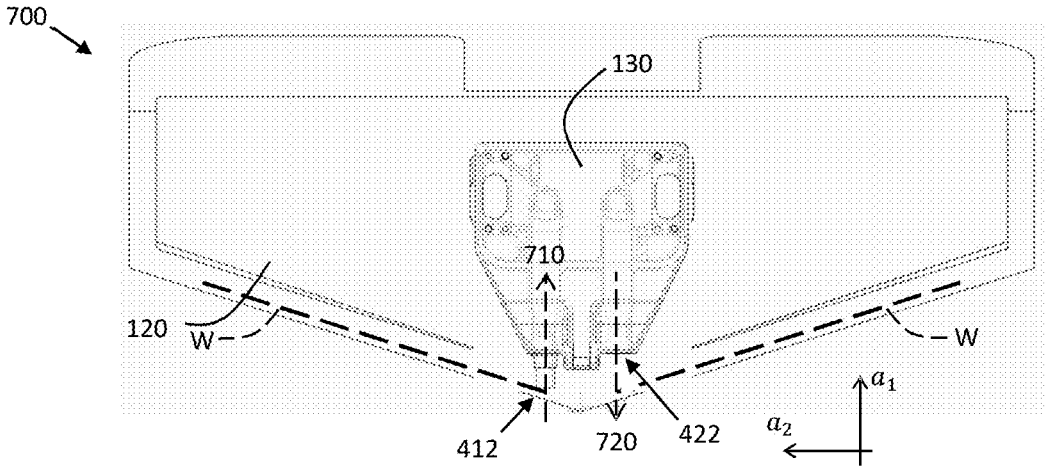
FIG. 7 illustrates an example single drive unit mounting example.

FIG. 7 illustrates a mounting example 700 where a single drive unit is to be mounted to the transom of the marine vessel. In this case the transom bracket 130 is centered on the transom, and the lower apertures 412, 422 are at equal distances from the water level W in use (which will follow the lower contour of the hull when the vessel is planing). Any of the first and second water channels can be selected as water intake 710 and water discharge 720. The selection may, e.g., be made based on other design considerations, such as the geometry of the cooling circuit inboard (on the other side of the plane P).

Figure 8:
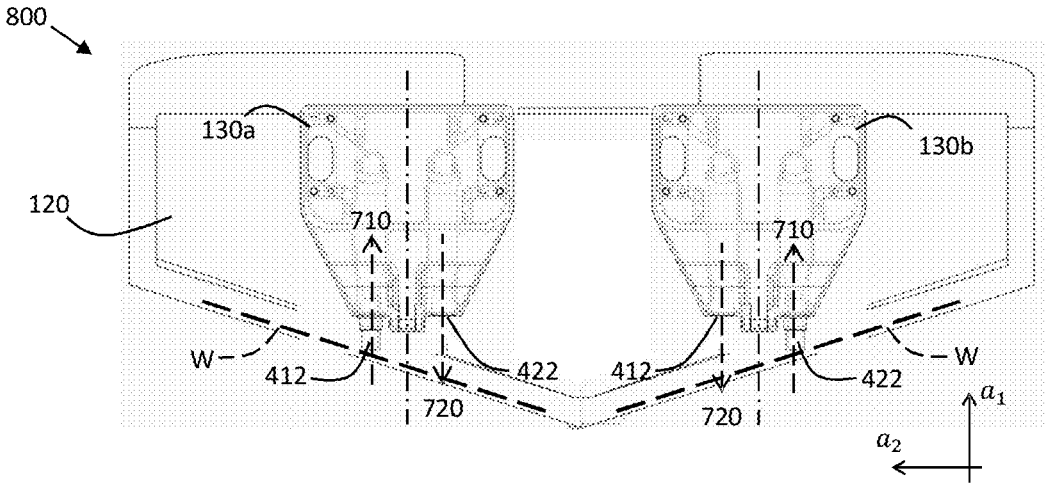
FIG. 8 illustrates an example twin drive unit mounting example.

FIG. 8 illustrates a twin drive mounting example 800 where two drive units are to be mounted to the transom of the marine vessel 100. In this case the lower apertures 412, 422 of the first and second water conduits 410, 420 at the two brackets 130*a*, 130*b* are at different distances from the water level W in use. The port bracket has its left water conduit lower aperture closer to the water surface while the starboard bracket has its right water conduit lower aperture closer to the water surface. It is therefore advantageous to choose different water conduits as water intake 710 and discharge 720 at the two brackets, where the water conduit with lower aperture closest to the water level W in use is selected as water intake and the other as water discharge.

There is also disclosed herein a marine drive unit assembly 101 that is based on the transom bracket 130 discussed above. The marine drive unit assembly comprises a drive unit 110 supported by the transom bracket 130, and a water pump 160. The drive unit 110 is arranged to be tilted from a nominal position 200 where at least part of the drive unit 110 is submerged in water as shown in FIG. 2 to an up-tilted position 300 where at least a propeller arrangement 140 of the drive unit 110 is above water, as illustrated in FIG. 3. The first water conduit 410, the second water conduit 420, and the water pump 160 forms part of a cooling circuit operable to transfer water via at least one of the first and second water conduits 410, 420 when the drive unit 110 is in the nominal position 200 and also when the drive unit 110 is in the up-tilted position 300. One out of the first water conduit 410 and the second water conduit 420 can be arranged as water intake and the other arranged as water discharge. The water intake aperture will remain submerged regardless of tilt position of the drive unit which is an advantage compared to drive unit assemblies that integrate water conduits in the drive unit lower part that is raised above the water line in the up-tilted position 300. Hence, the cooling function of the cooling circuit is not lost when moving the drive unit 110 into the up-tilted position 300, which is an advantage. For instance, the electrical energy storage component 170 can receive cooling during charging even though the drive unit 110 is in the up-tilted position when charging.

The cooling circuit optionally comprises a first sub-circuit extending via the electrical energy storage 170 comprised in the marine drive unit assembly 101 such that the temperature of the electrical energy storage 170 can be regulated. A second sub-circuit of the cooling circuit may pass via the electric machine 150 comprised in the drive unit 110 in order to cool the electric machine in use. The cooling circuit may also comprise a valve arrangement configurable to exclude the electric machine 150 from the cooling circuit when the drive unit 110 is in the up-tilted position 300. This way the cooling pump 160 does not need to pump cooling media via the electric machine 150 in case the electric machine is up-tilted and not in use. It is noted that at least some aspects of the transom brackets discussed herein are applicable also together with more conventional combustion engine based drive units, and also with hybrid drive units that comprise both combustion engine and electric machine power sources.

The water pump 160 and the drive unit 110 can in some case be separated by the plane P, i.e., the water pump 160 can be arranged inboard while the drive unit 110 is outboard. In other examples the water pump 160 is integrated in the drive unit 110, i.e., separated from the vessel hull by the plane P. The electrical energy storage 170 and the drive unit 110 are normally separated by the plane P, i.e., the electrical energy storage 170 is normally located inboards while the drive unit is located outboards.

Figure 9A:
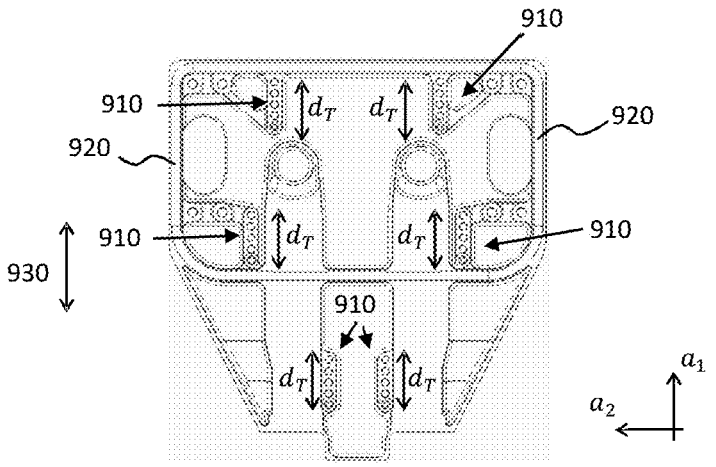
FIGS. 9A-B illustrate example fastening option arrays formed in a transom bracket.
Figure 9B:
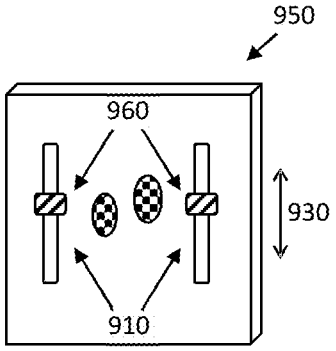

A boat builder often desires to adjust the position of the drive unit 110 along the z-axis, i.e., the vertical position of the drive unit 110. It may be challenging to optimize the position of the drive unit from computer simulations alone, even if the hull shape is known. Hence, some adjustment is often necessary after field trials. The optimal location of the drive unit or units may also depend on the boat configuration, i.e., its weight distribution and selected equipment options. To allow adjustment of the drive unit position on the transom in a convenient manner, there is disclosed herein a transom bracket 130 for supporting a marine drive unit 110 on a hull 120 of a marine vessel 100 that can be offset vertically by means of one or more fastening option arrays. A fastening option array is a selection of fastening options that the boat builder can choose from in order to position the transom bracket 130 at least vertically on the transom. FIG. 9A illustrates an example transom bracket 130 with fastening option arrays in the form of bolt-hole arrays that extend over a translation distance $d_T$ measured along the first axis $a_1$. The example bracket in FIG. 9B has two apertures (indicated as checkered regions). The boatbuilder can offset the transom bracket 130 vertically 930 by selecting one of the fastening options in the arrays, i.e., in this case one of the bolt holes in the line of bolt holes. FIG. 9B schematically illustrates another example 950 where vertical slots have been formed in the transom bracket, with clamping devices 960 that are operable to lock the transom bracket in a desired vertical position. The slots may be complemented by matching surface shapes on the transom bracket and on the transom, such as a saw-tooth pattern on the like in order to better hold the transom bracket in position. A fastening option array 480 can be realized in many different ways. It is, generally, configured to allow offset of the transom bracket 130 relative to the hull 120 along the first axis $a_1$ by the translation distance $d_T$. The transom brackets 130 discussed herein preferably comprise at least one such fastening option array 480 extending over the translation distance $d_T$ measured along the first axis $a_1$. The fastening option array geometries are preferably identical to each other, which means that a boat builder or other technician wishing to adjust the location of the drive unit on the transom can select an alternative fastening option in the fastening option array. The fastening option arrays may in some cases extend along both the first axis $a_1$ and the second axis $a_2$, although the examples in the Figures only show extension along a straight line parallel to the first axis $a_1$. An array of bolt holes is a fastening option array, so is an array of bolts fixed to the transom bracket.

The array of fastening options may also comprise a slot extending along the first axis as exemplified in FIG. 9B, possibly with some form of structure to provide friction in the vertical direction, such as a saw-tooth structure.

The transom bracket 130 comprises one or more apertures 411, 421, 470, 471 as discussed above, facing transversal to the plane P, and configured to route media such as electrical harness, hydraulic connections, and control signal interface cables (both mechanical and electrical), past the plane P to and from the marine drive unit 110, via a routing area R in the plane P. The routing area R extends over a routing area distance $d_R$ measured along the first axis $a_1$. The routing area distance $d_R$ is illustrated schematically in FIG. 10, top, 1010. The routing area R is basically the required area in the plane P to pass all the necessary connections and conduits to and from the drive unit 110. A cutout geometry, i.e., a hole, is formed in the transom to pass the routing media. This cutout geometry extends over a cutout distance $d_C$ measured along the first axis $a_1$. FIG. 11 shows an example hole formed in the transom that extends over the cutout distance $d_C$. A seal has to extend by at least $d_C+d_T$ on the transom bracket, measured along the first axis, in order to cover the cutout geometry extending over the cutout distance $d_C$.

The transom bracket 130 comprises a sealing arrangement 920 that is exemplified in FIG. 9A. This sealing arrangement 920 is configured to seal against the hull 120 in direction of the third axis $a_3$. The sealing arrangement 920 extends along the periphery of a sealing region S in the plane P. The sealing region S is arranged to define a region in the plane at least as large as to maintain the seal against the hull during translation of the transom bracket 130 along the first axis $a_1$ by the translation distance $d_T$.

The upper apertures 411, 421 of the first and second water conduits formed in the upper part 401 of the bracket 130 are preferably comprised in the sealing region S and the lower apertures 412, 422 formed in the lower part 402 of the transom bracket 130 are external to the sealing region S, as exemplified in FIG. 9A.

It is desired to be able to move the transom bracket 130 vertically on the transom by selecting a fastening option in the array or arrays, without reconfiguring the cutout geometry in the transom, i.e., without changing the position and dimension of the hole cut in the transom to route media to and from the drive unit 110.

Figure 10:
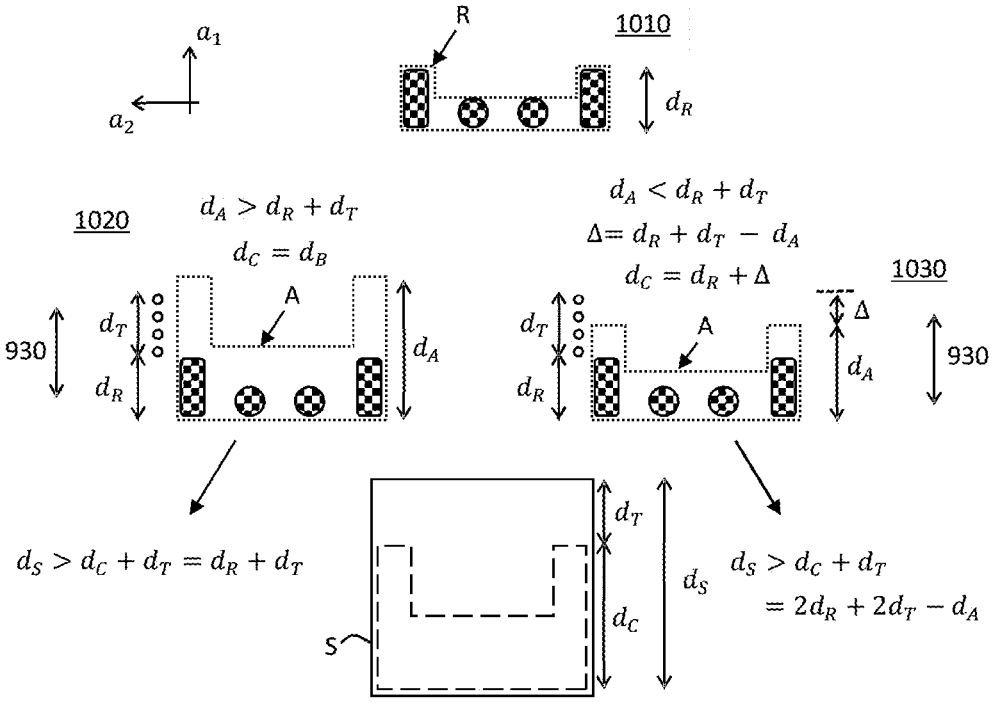
FIG. 10 schematically illustrate geometrical aspects of a transom bracket sealing region.
Figure 11:
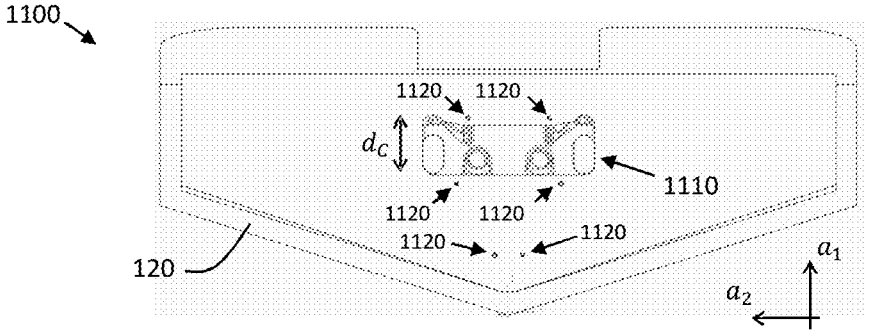
FIG. 11 shows an example cutout geometry associated with a transom bracket.

According to a first option, lateral offset is made possible if the transom bracket 130 has apertures that span over a large enough distance along the first axis $a_1$ to allow vertical offset of the transom bracket 130 without changing media position relative to the transom, as illustrated in FIG. 10 middle left 1020. The one or more apertures 411, 421, 470, 471 here define an aperture area A that extends over an aperture distance $d_A$ measured along the first axis $a_1$, which aperture distance $d_A$ is larger than or equal to a sum of the routing area distance $d_R$ and the translation distance $d_T$, i.e., $d_A>d_R+d_T$. For all installations on all transoms, the transom bracket 130 is arranged offsetable over the routing area R along the first axis $a_1$ by the difference between the aperture distance $d_A$ and the routing area distance $d_R$, regardless of the cutout geometry in the transom. As the transom bracket is repositioned vertically, the routing media can in this case stay in place relative to the transom, since the apertures formed in the transom are large enough in the vertical dimension to support the repositioning off the transom bracket. This can be understood from FIG. 10 middle left 1020, where the dashed region A moves relative to the checkered regions as the transom bracket is offset vertically. In this case the sealing region S extends over a sealing distance $d_S$ measured along the first axis $a_1$ that is at least as large as the sum of the routing area distance $d_R$ and the translation distance $d_T$. Thus, regardless of the selection of fastening option in the fastening option array or arrays, the seal will seal the cutout geometry formed in the transom as well as the apertures of the transom bracket.

Vertical displacement of the transom bracket 130 over the translation distance $d_T$ with maintained sealing function by the sealing arrangement 920 can be achieved also if $d_A<d_R+d_T$ as long as the cutout geometry in the transom is adapted to allow vertical displacement, as illustrated in FIG. 10, middle right 1030. In this case the one or more apertures 411, 421, 470, 471 in the transom bracket 130 define an aperture area A that extends over an aperture distance $d_A$ measured along the first axis $a_1$ that is smaller than a sum of the routing area distance $d_R$ and the translation distance $d_T$. The transom bracket 130 is again arranged offsetable over the routing area R along the first axis $a_1$ by the difference between the aperture distance $d_A$ and the routing area distance $d_R$. A difference $\Delta=d_R+d_T-d_A$ is what is missing to allow the vertical displacement, and this remainder has to be cut out from the transom, i.e., added to the cutout geometry formed in the transom to increase the cutout distance $d_C$.

In other words, the cutout region in the transom needs a vertical extension length along the first axis of at least $d_C=d_R+\Delta$. This can be understood from the illustration in FIG. 10, middle right 1030. As the transom bracket 130 is offset vertically, the routing area R will first move vertically within the transom apertures (and not relative to the transom), but not all of the required translation distance $d_T$. The routing are R will therefore have to be displaced relative to the transom, which means that it needs to move within the transom cutout also. The distance it needs to move inside the transom cutout is Δ. In this case the sealing region S extends over a sealing distance $d_S$ measured along the first axis $a_1$ that is at least as large as the difference between twice the sum of the routing area distance $d_R$ and the translation distance $d_T$ and the aperture distance $d_A$, i.e., $d_S=2d_R+2d_T-d_A$. This simplifies to $d_S=d_R+2d_T$ in case $d_R=d_A$.

The transom bracket 130 preferably comprises one or more fastening option arrays 480 arranged extending over a lateral fastening option array distance measured along the second axis $a_2$. Although a single fastening option array could be possible, having more than one array improves the mechanical strength of the connection between transom bracket and drive unit. The sealing region S is arranged to define a region in the plane P at least as large as to maintain seal against the hull during translation of the transom bracket 130 along the second axis $a_2$ by the lateral fastening option array distance.

At least one fastening option array 480 may extend along a straight line parallel to the first axis $a_1$, as illustrated in FIG. 9A. The at least one fastening option array 480 may also comprise at least two bolt holes, and preferably five bolt holes. The bolt holes in the at least one fastening option array 480 are preferably separated by between 10-20 mm, and preferably 16 mm. At least four fastening option arrays 480, and preferably six fastening option arrays 480 hold the transom bracket in position relative to the transom.

At least one of the fastening option arrays 480 is preferably enclosed by the sealing region S, although one or more fastening option arrays 480 can also be located external to the sealing region S, as illustrated in FIG. 9A. At least one of the apertures 470, 471 may be elongated in direction of the first axis $a_1$.

The sealing arrangement 920 may comprise a groove arranged to receive a replaceable sealing member. This is an advantage since a fresh seal can easily be mounted when the position of the bracket on the transom is changed. Thus, when changing the position of the drive unit on the transom, the bolts in the fastening option arrays are loosened and removed, whereupon the sealing member can be replaced and the transom mounted at another location, i.e., using another set of holes in the fastening option arrays 480.

FIG. 11 shows a view 1100 from inside the vessel 100, looking out at the transom bracket 130 in position on the transom of the hull 120. A cutout geometry 1110 has been formed in the transom in order to accommodate the routing media that passes to and from the drive unit 110. Bolt holes 1120 are schematically indicated in FIG. 11. The bolt holes are used to hold the transom bracket 130 securely in position relative to the transom.

Figure 12:
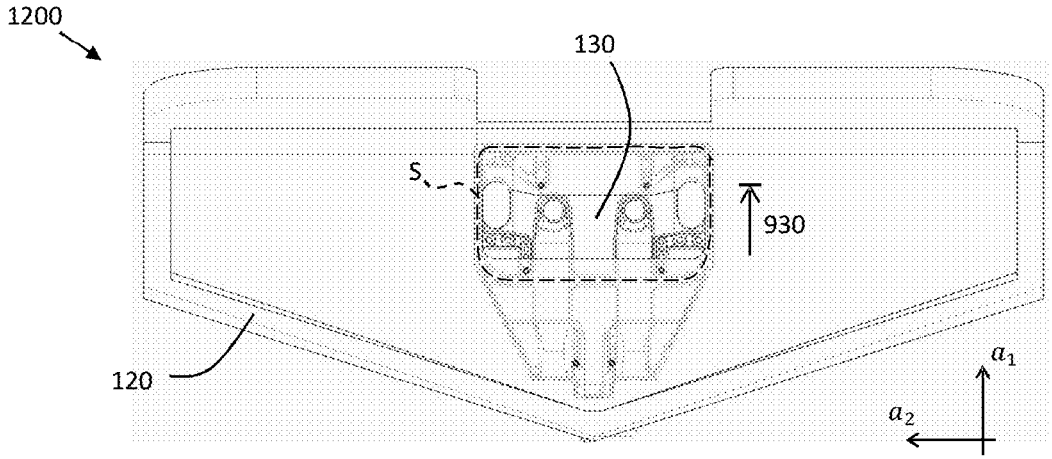
FIG. 12 shows a first transom bracket adjustment example.

FIG. 12 shows a view 1200 illustrating the example transom bracket 130, seen through the transom of the vessel 100. The transom bracket 130 is here offset vertically 930 upwards as far as it can go. Any further displacement of the transom bracket will cover one or more apertures by the transom, i.e., any further vertical offset will be resisted by the routing media that requires an opening at least as large as the routing area R.

Figure 13:
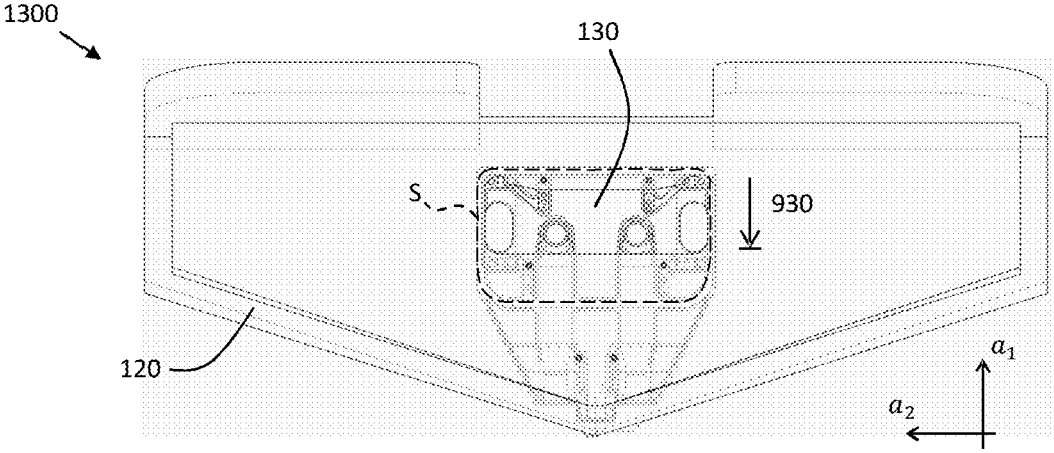
FIG. 13 shows a second transom bracket adjustment example.

FIG. 13 shows a view 1300 where the transom bracket 130 has instead been offset vertically 930 downwards as far as it can go.

Note that the sealing region S seals the interface between transom bracket and transom in both vertical positions.

Figure 14:
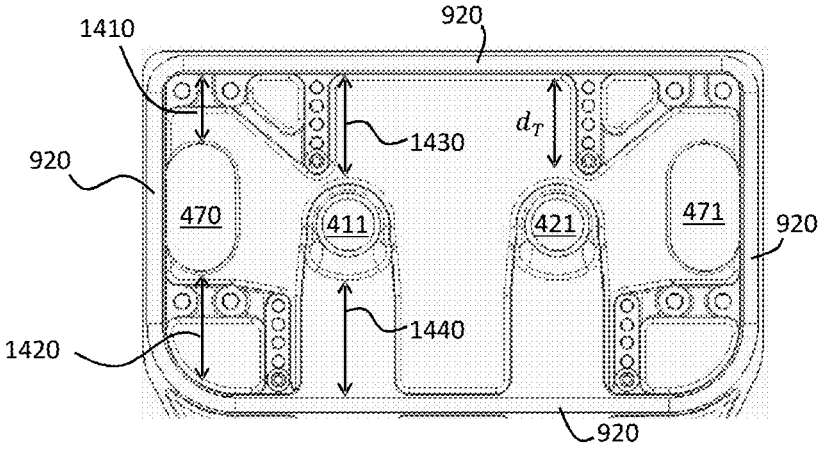
FIG. 14 illustrates details of a transom bracket sealing arrangement.

FIG. 14 illustrates some geometrical considerations that are generally applicable to transom brackets according to the teachings herein.

According to some aspects, a distance 1410, 1420 from the sealing arrangement 920 to the closest aperture upwards and/or downwards on the transom bracket in use, measured along the first axis $a_1$, is at least as large as the translation distance $d_T$.

According to some aspects, the shortest distance 1410, 1420 measured along the first axis $a_1$ from an aperture in the transom bracket 130 to the sealing arrangement 920 is at least 50 mm, and preferably more than 60 mm.

According to some aspects, the distance 1430 measured along the first axis $a_1$ and upwards from the upper apertures of the water conduits 411, 421 to the sealing arrangement 920 is at least as large as the translation distance $d_T$.

According to some aspects, at least a part of a contour of the cutout in the transom is arranged to match a peripheral contour of at least one aperture in the transom bracket 130. This can be seen from, e.g., FIG. 13, where the oval apertures have radii that match the contour of the cutout.

It is of course understood that the sealing region should be made as small as possible, while satisfying the above geometry constrains, in order to not cause an inflation of the size of the transom bracket beyond what is necessary to maintain the seal for all possible vertical offsets of the drive unit. Hence, according to some aspects, a distance 1410, 1420 from the scaling arrangement 920 to the closest aperture upwards and/or downwards on the transom bracket in use, measured along the first axis $a_1$, is at most as large as twice the translation distance $d_T$. According to some aspects, the shortest distance 1410, 1420 measured along the first axis $a_1$ from an aperture in the transom bracket 130 to the sealing arrangement 920 is at most 150 mm. The distance 1430 measured along the first axis $a_1$ and upwards from the upper apertures of the water conduits 411, 421 to the sealing arrangement 920 is at most as large as twice the translation distance $d_T$.

The terminology used herein is for the purpose of describing particular aspects only and is not intended to be limiting of the disclosure. As used herein, the singular forms "a," "an," and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including" when used herein specify the presence of stated features, integers, actions, steps, operations, elements, and/or components, but do not preclude the presence or addition of one or more other features, integers, actions, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present disclosure is not limited to the aspects described above and illustrated in the drawings; rather, the skilled person will recognize that many changes and modifications may be made within the scope of the present disclosure and appended claims. In the drawings and specification, there have been disclosed aspects for purposes of illustration only and not for purposes of limitation, the scope of the disclosure being set forth in the following claims.

The invention claimed is:

1. A transom bracket for supporting a marine drive unit on a hull of a marine vessel, the transom bracket extending in a plane spanned by a first axis and by a second axis, where a third axis is normal to the plane, the transom bracket comprising one or more apertures facing transversal to the plane, the one or more apertures being arranged to route media past the plane to and from the marine drive unit, via a routing area in the plane, where the routing area extends over a routing area distance measured along the first axis, the transom bracket comprising at least one fastening option array extending over a translation distance measured along the first axis, where the fastening option array is configured to allow offset of the transom bracket relative to the hull along the first axis by the translation distance, the transom bracket comprising a sealing arrangement configured to seal against the hull in direction of the third axis, where the sealing arrangement extends along the periphery of a sealing region in the plane, where the sealing region is a region in the plane at least as large as to maintain seal against the hull during translation of the transom bracket along the first axis by the translation distance, where the one or more apertures define an aperture area that extends over an aperture distance measured along the first axis, where the aperture distance is larger than or equal to a sum of the routing area distance and the translation distance, where the transom bracket is arranged offsetable over the routing area along the first axis by the difference between the aperture distance and the routing area distance, where the sealing region extends over a sealing distance measured along the first axis that is at least as large as the sum of the routing area distance and the translation distance.

2. The transom bracket according to claim 1, where the one or more apertures define an aperture area that extends over an aperture distance measured along the first axis that is smaller than a sum of the routing area distance and the translation distance, where the transom bracket is arranged offsetable over the routing area along the first axis by the difference between the aperture distance and the routing area distance, where the sealing region extends over a sealing distance measured along the first axis that is at least as large as the difference between twice the sum of the routing area distance and the translation distance and the aperture distance.

3. The transom bracket according to claim 1, where a distance from the sealing arrangement to the closest aperture upwards and/or downwards on the transom bracket in use, measured along the first axis, is at least as large as the translation distance.

4. The transom bracket according to claim 1, where the at least one fastening option array extends along a straight line parallel to the first axis.

5. The transom bracket according to claim 1, where the at least one fastening option array comprises at least two bolt holes.

6. The transom bracket according to claim 5, where the bolt holes in the at least one fastening option array are separated by between 10-20 mm.

7. The transom bracket according to claim 1, comprising at least four fastening option arrays.

8. The transom bracket according to claim 1, where at least one of the fastening option arrays is enclosed by the sealing region.

9. The transom bracket according to claim 1, where at least one of the fastening option arrays is located external to the sealing region.

10. The transom bracket according to claim 1, where at least one of the apertures is elongated in direction of the first axis.

11. The transom bracket according to claim 1, where the sealing arrangement comprises a groove arranged to receive a replaceable sealing member.

12. The transom bracket according to claim 1, comprising a first water conduit and a second water conduit integrated in the transom bracket, where the first water conduit and the second water conduit extend from respective upper apertures formed in an upper part of the transom bracket to respective lower apertures formed in a lower part of the transom bracket.

13. The transom bracket according to claim 12, where the upper apertures formed in the upper part of the bracket are comprised in the sealing region and where the lower apertures formed in the lower part of the transom bracket are external to the sealing region.

14. The transom bracket according to claim 12, where at least one of the first and second water conduits comprises an adjustable length portion arranged at its lower aperture and extensible in direction of the first axis by at least the first fastening option array distance.

15. The transom bracket according to claim 1, where the transom bracket comprises one or more fastening option arrays arranged extending over a lateral fastening option array distance measured along the second axis, where the sealing region is arranged to define a region in the plane at least as large as to maintain seal against the hull during translation of the transom bracket along the second axis by the lateral fastening option array distance.

16. The transom bracket according to claim 1, arranged to support the drive unit in a pivotable manner such that the drive unit can be pivoted relative to the transom bracket into an up-tilted storage position.

17. The transom bracket according to claim 16, arranged to support the drive unit about a first pivot axis and about a second pivot axis that is spatially offset from the first pivot axis.

18. A marine drive unit comprising a transom bracket according to claim 1.

19. A marine vessel comprising a marine drive unit according to claim 18.

* * * * *